US008869915B2

(12) United States Patent
Knolle

(10) Patent No.: US 8,869,915 B2
(45) Date of Patent: Oct. 28, 2014

(54) SYSTEMS AND METHODS FOR SONIC SUBSURFACE MATERIAL REMOVAL

(71) Applicant: Longyear TM, Inc., South Jordan, UT (US)

(72) Inventor: Mark Knolle, Marietta, OH (US)

(73) Assignee: Longyear TM, Inc., South Jordan, UT (US)

( * ) Notice: Subject to any disclaimer, the term of this patent is extended or adjusted under 35 U.S.C. 154(b) by 56 days.

(21) Appl. No.: 13/727,678

(22) Filed: Dec. 27, 2012

(65) Prior Publication Data

US 2014/0021772 A1 Jan. 23, 2014

Related U.S. Application Data

(60) Provisional application No. 61/674,809, filed on Jul. 23, 2012, provisional application No. 61/674,356, filed on Jul. 22, 2012.

(51) Int. Cl.
*E21B 7/00* (2006.01)
*E21C 37/14* (2006.01)

(52) U.S. Cl.
CPC ..... *E21C 37/14* (2013.01)
USPC ..... 175/60

(58) Field of Classification Search
USPC ..... 299/3, 5, 6, 16, 17; 175/60, 403, 404, 175/405.1; 166/372
See application file for complete search history.

(56) References Cited

U.S. PATENT DOCUMENTS

| | | | | |
|---|---|---|---|---|
| 2,537,605 | A * | 1/1951 | Sewell | 175/205 |
| 3,208,538 | A * | 9/1965 | Pitcher | 175/135 |
| 3,338,322 | A * | 8/1967 | Henderson | 175/317 |
| 5,181,578 | A | 1/1993 | Lawler | |
| 5,562,169 | A | 10/1996 | Barrow | |
| 6,460,936 | B1 | 10/2002 | Abramov et al. | |
| 7,806,204 | B2 | 10/2010 | Oothoudt | |
| 2009/0283326 | A1 * | 11/2009 | Oothoudt | 175/58 |

FOREIGN PATENT DOCUMENTS

EP 0775535 A2 5/1997

OTHER PUBLICATIONS

International Search Report and the Written Opinion of the International Search Authority for Application No. PCT/US/2012/071760 (mailed Apr. 26, 2013).

* cited by examiner

*Primary Examiner* — Sunil Singh
(74) *Attorney, Agent, or Firm* — Ballard Spahr LLP

(57) ABSTRACT

A system for removing desired subsurface materials. A drilling system has a sonic drill head assembly capable of rotating a drill string and transmitting oscillating forces to the drill string. A material removal system comprises an outer tube attachable to the drill string. An inner tube has an outer diameter sized so that that at least a portion of the inner tube is positionable in an inner volume of the outer tube with an annular void defined between the outer tube and the inner tube. A distal end of the inner tube defines at least one opening such that an interior conduit of the inner tube is in fluid communication with the annular void outside of the distal end of the inner tube. Pressurized fluid can be urged from the annular void through the opening to the interior conduit, entraining the desired subsurface materials therein for removal to a discharge tank.

22 Claims, 6 Drawing Sheets

SYSTEMS AND METHODS FOR SONIC SUBSURFACE MATERIAL REMOVAL

CROSS REFERENCE TO RELATED APPLICATIONS

This application claims the benefit of priority to U.S. Provisional Patent Application Ser. No. 61/674,356, filed on Jul. 22, 2012, and U.S. Provisional Patent Application Ser. No. 61/674,809, filed on Jul. 23, 2012 the entire disclosures of which are incorporated by reference in their entirety.

FIELD OF THE INVENTION

This application relates generally to systems and methods for removing materials below the surface of the earth. More specifically, this application relates to systems and methods for removing subsurface materials without excavating the overburden using "open pit", "floating dredge" or other conventional excavation methods.

BACKGROUND TECHNOLOGY

Core drilling allows sampling of subterranean materials from various depths to be obtained for many purposes. For example, drilling a core sample and testing the retrieved core helps determine what materials are present or are likely to be present in a given formation. For instance, a retrieved core sample can indicate the presence of petroleum, precious metals, sand, and other desirable materials. Accordingly, core samples can be used to determine the desirability of further exploration and/or mining in a given area.

In sonic core drilling processes, variable frequency vibration is created by an oscillator. The vibration is then mechanically transferred to the drill string of the core barrel and/or casing. The vibration is transmitted in an axial direction down through the drill string to an open-faced drill bit. As a result, the drill string may be rotated and/or mechanically pushed as it is vibrated into the subsurface formation.

Often, sonic core drilling processes are used to retrieve a sample of material from a desired depth below the surface of the earth. Although there are several ways to collect core samples, core barrel systems are often used for core sample retrieval. Core barrel systems include an outer tube with a coring drill bit secured to one end. The opposite end of the outer tube is often attached to a drill string that extends vertically to a sonic drill head that is often located above the surface of the earth. The core barrel systems also may include an inner polycarbonate tube located within the outer core barrel. As the drill bit cuts formations in the earth, the inner tube can be filled with a core sample. Once a desired amount of a core sample has been cut, the inner tube, core barrel, and core sample can be brought up through the drill string and retrieved at the surface.

The sonic drill head may include high-speed, rotating counterbalances that produce resonant energy waves and a corresponding high-speed vibration to be transmitted through the drill string to the core barrel. As a result, the sonic drill head can vertically vibrate the core barrel. In addition, the drill head can rotate and/or push the core barrel into the subsurface formation to obtain a core sample. Once the core sample is obtained, the core barrel (containing the core sample) is retrieved by removing the entire drill string out of the borehole that has been drilled. Once retracted to the surface, the core sample may then be removed from the core barrel.

In a sonic wireline drilling process, the core barrel and the casing are advanced together into the formation. The casing again has an open-faced drill bit and is advanced into the formation. However, the core barrel (inner tube) does not contain a drill bit or connect to a drill string. Instead, the core barrel mechanically latches inside of and at the bottom of the casing and advances into the formation along with the casing. When the core sample is obtained, a drill operator can retrieve the core barrel using a wireline system. Thereafter, the drill operator can remove the core sample from the core barrel at the surface, and then drop the core barrel back into the casing using the wire line system. As a result, the wireline system eliminates the time needed to trip the drill rods and drill string in and out of a borehole for retrieval of the core sample.

Conventionally, upon detecting the presence of subterranean desirable materials, such as precious metals, sand and the like, an open pit mine is dug. In open pit mining, a large pit is dug and the overburden material positioned over the desirable materials is removed and hauled to a different location. However, forming an open pit mine is very time-consuming and expensive. Often an extensive dewatering system is required. There is also a large carbon footprint as millions of tons of overburden material removed from the open pit are trucked away. Further, there can be large capital costs in excavation equipment and infrastructure such as roads in order to form the open pit. Moreover, in some instances the open pit can be refilled, increasing cost as the removed overburden material is returned to the pit.

Thus, there is a need in the art for systems and methods for removing desirable subsurface materials without the need to dig an open pit mine to remove the overburden waste material. The present invention fulfills these needs and provides further related advantages as described herein The subject matter claimed herein is not limited to embodiments that solve any disadvantages or that operate only in environments such as those described above. Rather, this background is only provided to illustrate one exemplary technology area where some embodiments described herein may be practiced.

SUMMARY

The invention relates to systems and methods for removing a desired subsurface material. In one aspect, the systems and methods for removing a desired subsurface material comprise removing subsurface materials without excavating the overburden waste material other than that excavated when forming a conventional exploratory borehole.

The system for removing desired subsurface materials comprises a drilling system and a material removal system. In one aspect, the drilling system comprises a drill head assembly capable of rotating a drill string and transmitting oscillating forces to the drill string. In use, the drill head assembly can cause a drill bit attached to the drill string to form a borehole extending into a surface. The drill string can line the borehole forming an outer casing.

The material removal system comprises a sonic air lift tooling system ("S3RP") and a discharge tank. In one aspect, the sonic air lift tooling system comprises an outer tube having an outer diameter and defining an inner volume. The outer tube annulus can be in fluid communication with a source of pressurized fluid, such as air, and the like.

The sonic air lift tooling system can further comprise an inner tube. In one aspect, the inner tube has an outer diameter sized so that that at least a portion of the inner tube can be positioned in the inner volume of the outer tube. In another aspect, the outer diameter of the inner tube can be sized so that an annular void is defined between the outer tube and the outer diameter of the inner tube. In a further aspect, a distal end of the inner tube can define at least one opening such that an interior conduit of the inner tube is in fluid communication with the annular void outside of the distal end of the inner tube. A proximal end of the inner tube can be in fluid communication with a discharge tank such that the interior conduit of the inner tube is in fluid communication with the discharge tank.

In use, the pressurized fluid, such as compressed air, and the like can be injected through the outlet tube inlet and into the annular void between the outer tube and the inner tube. The pressurized fluid can be urged towards the distal end of the inner tube. Upon reaching the distal end of the inner tube, in one aspect, the pressurized fluid can pass from the annular void through the opening to the interior conduit of the inner tube. Because the desired subsurface material can be a flowing material, such as, for example and without limitation, sand, the desired subsurface material can become entrained in the fluid in the interior conduit of the tube. In the interior conduit of the tube, the fluid and the desired subsurface material entrained therein can be "lifted" or otherwise urged to the discharge tank.

In other aspects, varying combinations of pressurized fluids and flow directions can be utilized. However, in each aspect, the desired material can be removed from below the surface using the same borehole that was formed during exploratory drilling without the need for additional overburden material removal.

For purposes of summarizing, some aspects, advantages and features of a few of the embodiments of the invention have been described in this summary. Some embodiments of the invention may include some or all of these summarized aspects, advantages and features. However, not necessarily all of (or any of) these summarized aspects, advantages or features will be embodied in any particular embodiment of the invention. Thus, none of these summarized aspects, advantages and features are essential. Some of these summarized aspects, advantages and features and other aspects, advantages and features may become more fully apparent from the following detailed description and the appended claims.

DETAILED DESCRIPTION OF THE DRAWINGS

The appended drawings contain figures of preferred embodiments to further clarify the above and other aspects, advantages and features. It will be appreciated that these drawings depict only preferred embodiments of the invention and are not intended to limit its scope. These preferred embodiments will be described and explained with additional specificity and detail through the use of the accompanying drawings in which.

DETAILED DESCRIPTION OF PREFERRED EMBODIMENTS

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a pipe" can include two or more such pipes unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

In one aspect, the system for sonic subsurface material removal can comprise a drilling system 100 and a material removal system 200.

Figure 1:
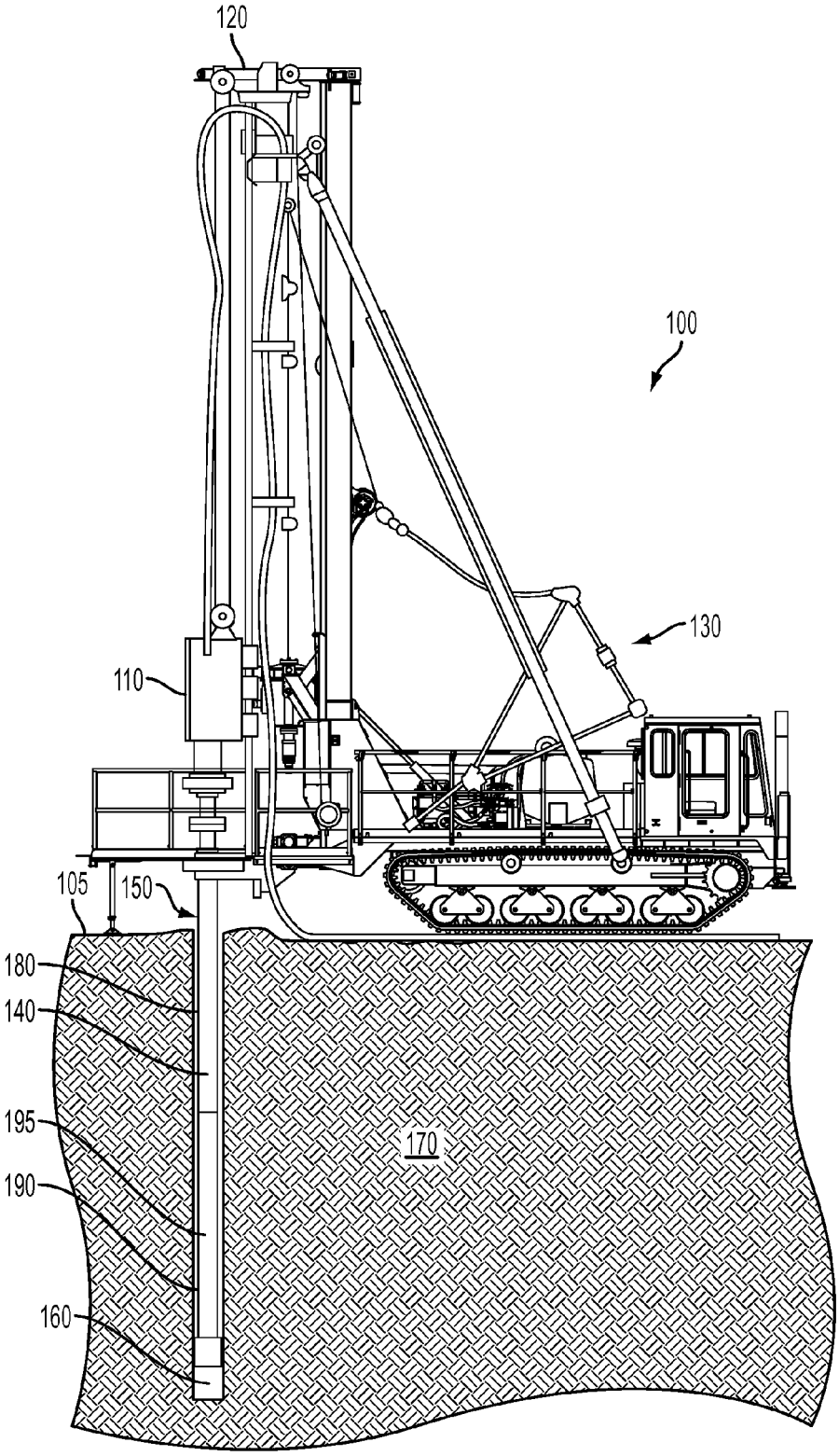
FIG. 1 is an elevational view of a drilling system, according to one example.

FIG. 1 illustrates a drilling system 100 for drilling into the surface 105 of the earth that comprises a drill head assembly 110. The drill head assembly can be coupled to a mast 120 that in turn is coupled to a drill rig 130. The drill head assembly 110 is configured to have a drill rod 140 coupled thereto to form a drill string 150. As can be appreciated, any number of drill rods can be added so that the drill string is the desired length. In turn, the drill string 150 can be coupled to a drill bit 160 configured to interface with the material to be drilled, such as a formation 170.

In at least one example, the drill head assembly 110 is configured to rotate the drill string 150. In particular, the rotational rate of the drill string 150 can be varied as desired during the drilling process. Further, the drill head assembly 110 can be configured to translate relative to the mast 120 to apply an axial force to the drill head assembly 110 to urge the drill bit 160 into the formation 170 during a drilling process. The drill head assembly 110 can also generate oscillating forces that are transmitted to the drill rod 140. These forces are then transmitted from the drill rod 140 through the drill string 150 to the drill bit 160.

Upon insertion of a drill rod 140 into a borehole 180, the drill rod can form an outer casing 190. As a result, a drill operator can use the outer casing to maintain the borehole. Once an outer casing is in place, the drill operator can trip a core barrel and its corresponding drill string into the borehole through an interior volume 195 of the outer casing and advance the core barrel ahead of the casing to retrieve a core sample. In another aspect, in a wireline drilling processes, a drill operator can simultaneously advance the casing and the core barrel together through a formation. Using a wireline process, the drill operator can trip the inner core barrel in and out of the drill string to obtain core samples from the core barrel.

In one aspect, the material removal system 200 of the system for sonic subsurface material removal comprises at least one of a sonic air lift tooling system 210, and a discharge tank 230.

Figure 2C:
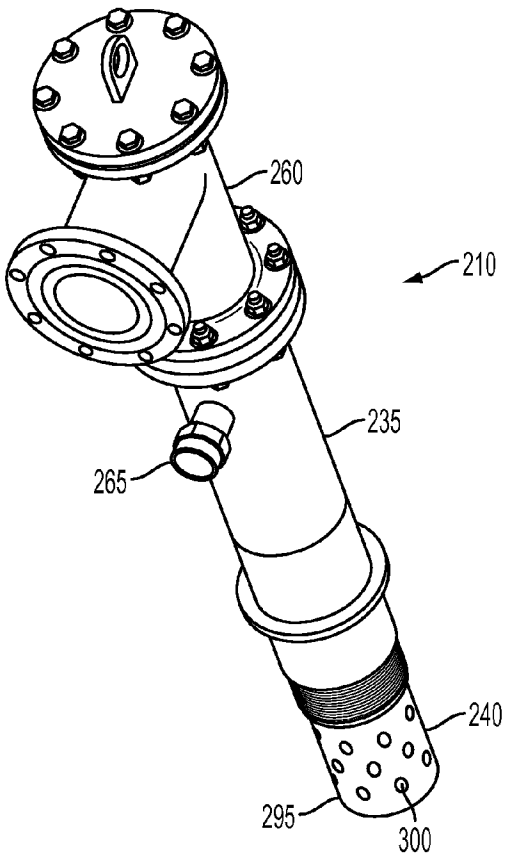
FIG. 2C is a perspective view of the sonic air lift tooling system of FIG. 2A.
Figure 2B:
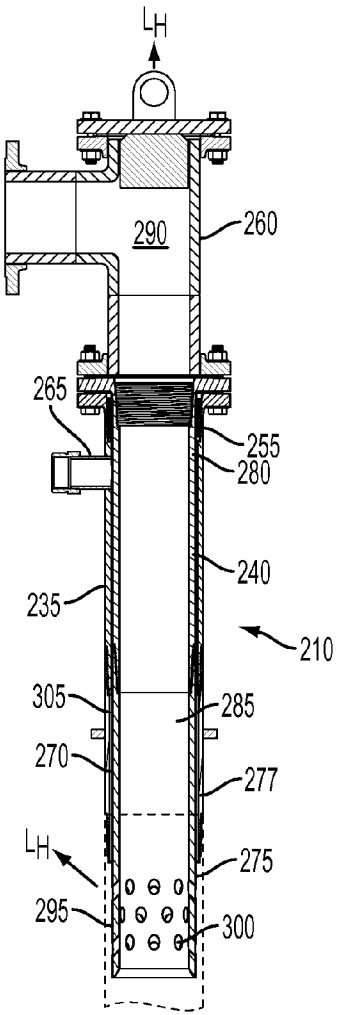
FIG. 2B is a cross-sectional view of the sonic air lift tooling system of FIG. 2A taken along line B-B of FIG. 2A.
Figure 2A:
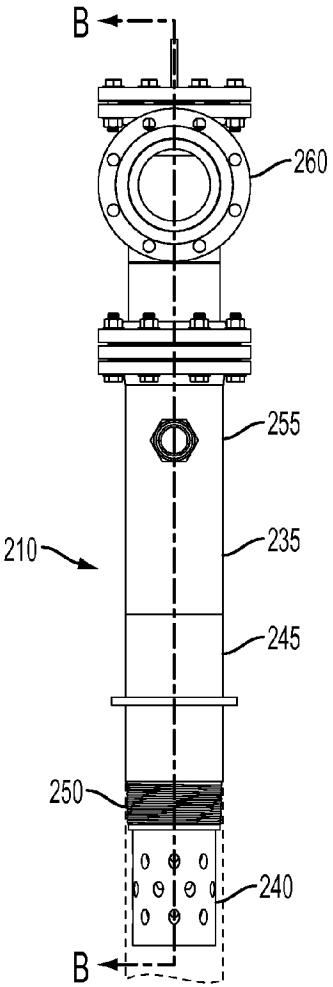
FIG. 2A is a side elevational view of a sonic air lift tooling system of a system for sonic subsurface material removal, according to one aspect.

With reference to FIGS. 2A, 2B and 2C, the sonic air lift tooling system 210 can, in one aspect, comprise an outer tube 235 and an inner tube 240. The outer tube can be sized such that at least a portion of the outer tube can be coupled to the outer casing 190 in the borehole. For example, at least a portion of the outer tube 235 can have an outer diameter 245 of about 4 inches, about 5 inches, about 6 inches, about 7 inches, about 8 inches, or greater than about 8 inches. In another aspect, a distal end 250 of the outer tube can be threaded to engage complementary threads on a portion of the outer casing. In a further aspect, an internal diameter of the outer tube 235 can be substantially the same as an internal diameter of the outer casing, and/or the external diameter of the outer tube can be substantially the same as the external diameter of the outer casing. In one aspect, a proximal end 255 of the outer tube 235 can be configured to couple to a discharge head 260.

In another aspect, an outer tube inlet 265 can be defined in a portion of the outer tube 235 of the sonic air lift tooling system 210. In this aspect, the outer tube inlet can be a boss configured to place an inner volume 270 of the outer tube in fluid communication with a source of pressurized fluid, such as air, and the like.

The inner tube 240 of the sonic air lift tooling system 210 can be sized such that at least a portion of the inner tube can be positioned in the inner volume 270 of the outer tube 235. For example, at least a portion of the inner tube can have an outer diameter 275 of less than about 4 inches, about 4 inches, about 5 inches, about 6 inches, about 7 inches, or greater than about 7 inches. In one aspect, the outer diameter of the inner tube 240 can be sized so that, when the inner tube is positioned in the inner volume 270 of the outer tube 235, an annular void 277 is defined between the outer tube and the inner tube 240. In another aspect, a proximal end 280 of the inner tube can be configured to couple to the discharge head 260 such that an interior conduit 285 of the inner tube is in fluid communication with an inner conduit 290 of the discharge head.

A distal end 295 of the inner tube 240 can be open such that a fluid can enter or exit the interior conduit of the inner tube. In one aspect, the distal end of the inner tube can define a plurality of holes 300. In this aspect, at least one hole of the plurality of holes can be angled from the center of the inner tube upwardly towards the outer diameter 275 of the inner tube 240. That is, the longitudinal axis $L_H$ of the at least one hole can be at an acute angle relative to the longitudinal axis $L_I$ of the inner tube. For example, an angle formed between the longitudinal axis $L_I$ of the inner tube and the longitudinal axis $L_H$ of the at least one hole 300 can be about 10 degrees, about 20 degrees, about 30 degrees, about 40 degrees, about 45 degrees, about 50 degrees, about 60 degrees, about 70 degrees, about 80 degrees, or about 90 degrees. In still another aspect, each hole of the plurality of holes can have a hole diameter of less than 0.25 inches, about 0.25 inches, about 0.50 inches, about 0.75 inches, about 1.0 inches, or greater than about 1 inch.

A central portion 305 of the inner tube 240 can connect the distal end 295 of the inner tube to the proximal end 280 of the inner tube. As can be appreciated, the central portion can have a length configured so that the proximal end of the inner tube 240 is positioned above the surface 105 of the formation 170 and the distal end of the inner tube is positioned in the borehole 180 at a desired depth, described more fully below. For example, the central portion 305 of the inner tube can comprise a plurality of inner tube sections that can be coupled together at the surface to form an inner tube having the desired length.

In one aspect, the discharge head 260 can be sized and configured so that material removed from the borehole 180 through the sonic air lift tooling system 210 can be redirected to the discharge tank 230. For example, material removed from the borehole can be urged through the interior conduit 285 of the inner tube, through the inner conduit 290 of the discharge head and to the discharge tank. In one aspect, at least a portion of the discharge head can have a diameter of about 3 inches, about 4 inches, about 5 inches, about 6 inches, about 7 inches, or greater than about 7 inches. It is contemplated that a variety of flanges, gaskets, fasteners, adapters and the like can be provided to couple portions of the sonic air lift tooling system and/or the discharge head together as necessary.

Figure 5:
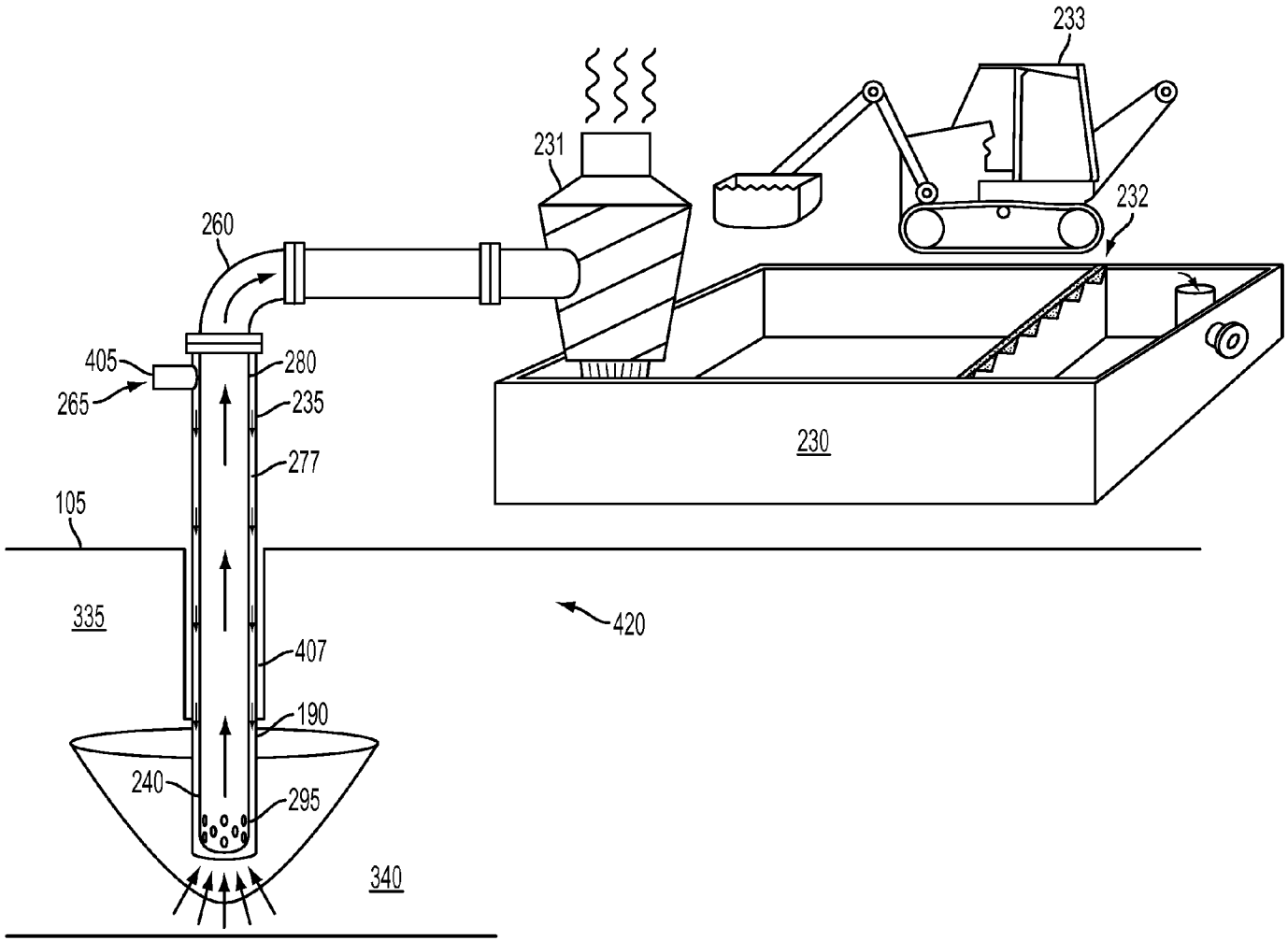
FIG. 5 is an elevational view of an exemplary system and method for sonic subsurface material removal, according to one aspect.
Figure 6:
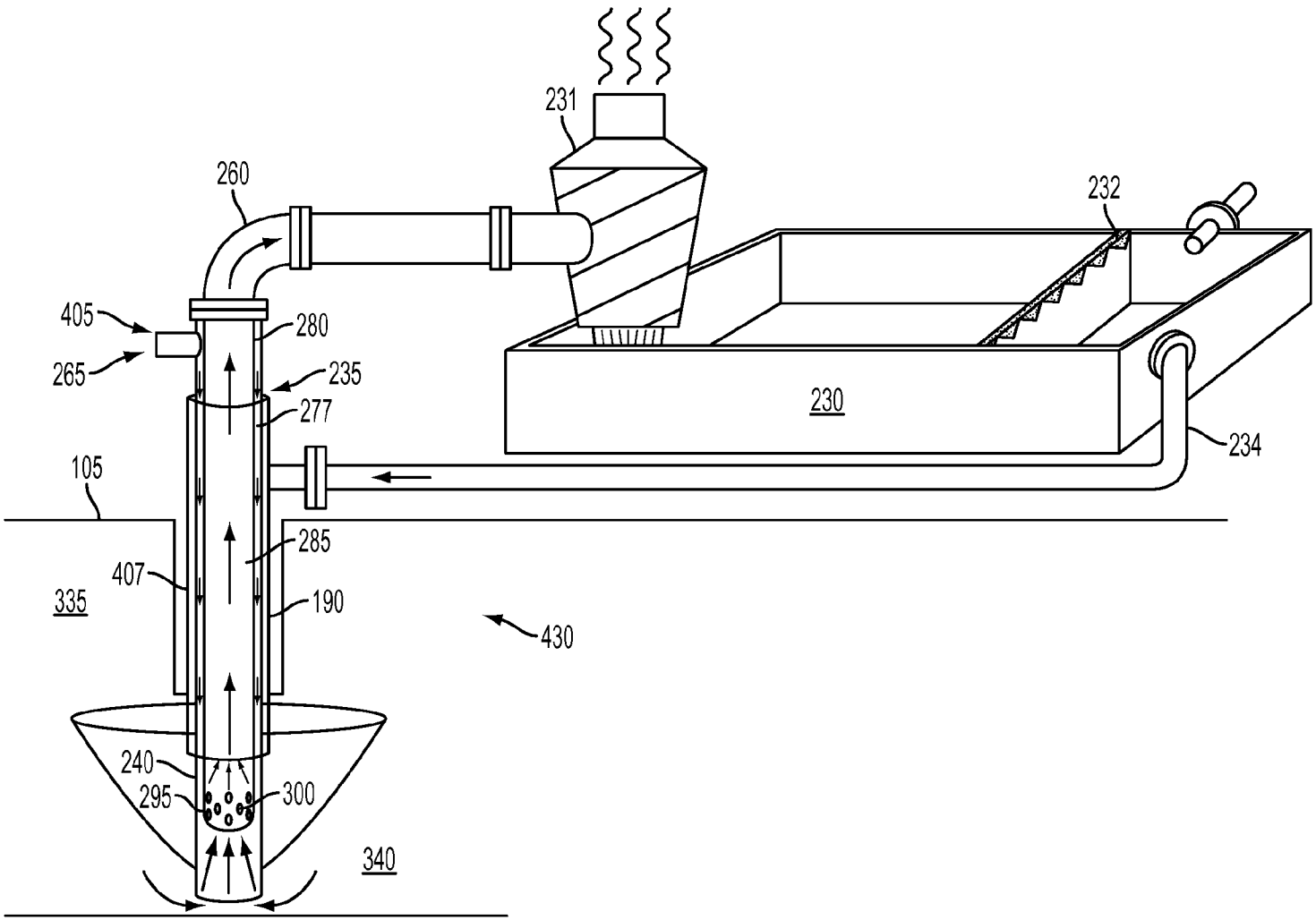
FIG. 6 is an elevational view of a second exemplary system and method for sonic subsurface material removal, according to one aspect.

The discharge tank 230, illustrated in FIGS. 5 and 6, can be a tank configured to hold a liquid, such as water. In one aspect, the discharge tank can comprise a recirculation baffle plate 232. The recirculation baffle plate can allow water to flow over the plate while restricting the flow of solids, such as a desired material 340, from passing over the plate. Thus, the recirculation baffle plate 232 can at least partially separate the desired material from water or other fluid it can become mixed with. In another aspect, the discharge tank can further comprise a recirculation line 234. In this aspect, the recirculation line can place the discharge tank in fluid communication with the outer tube inlet 265 of the sonic air lift tooling system 210 so that water from the discharge tank can be selectively directed to the inner volume 270 of the outer tube 235. Optionally, the discharge tank can further comprise at least one of a cyclone 231 and a backhoe 233, as known in the art, configured to further separate and/or remove the desired material from the fluid in the discharge tank. It is of course contemplated that the discharge tank 230 can further comprise at least one overflow drain, flow meter, valve and the like as necessary to process water discharged from and/or injected into the material removal system 200.

Figure 3:
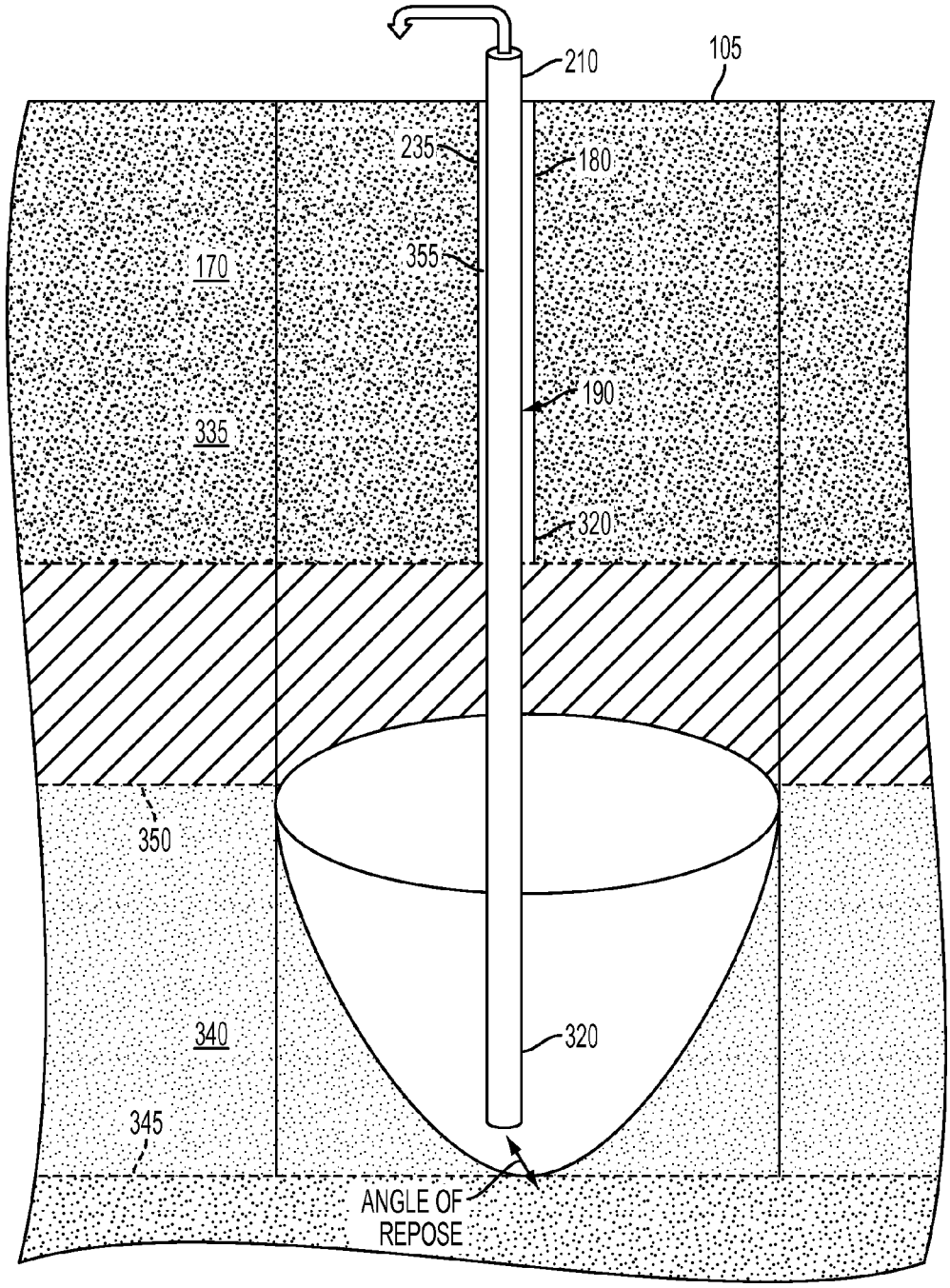
FIG. 3 is a schematic diagram illustrating a system and method for sonic subsurface material removal, according to one aspect.
Figure 4:
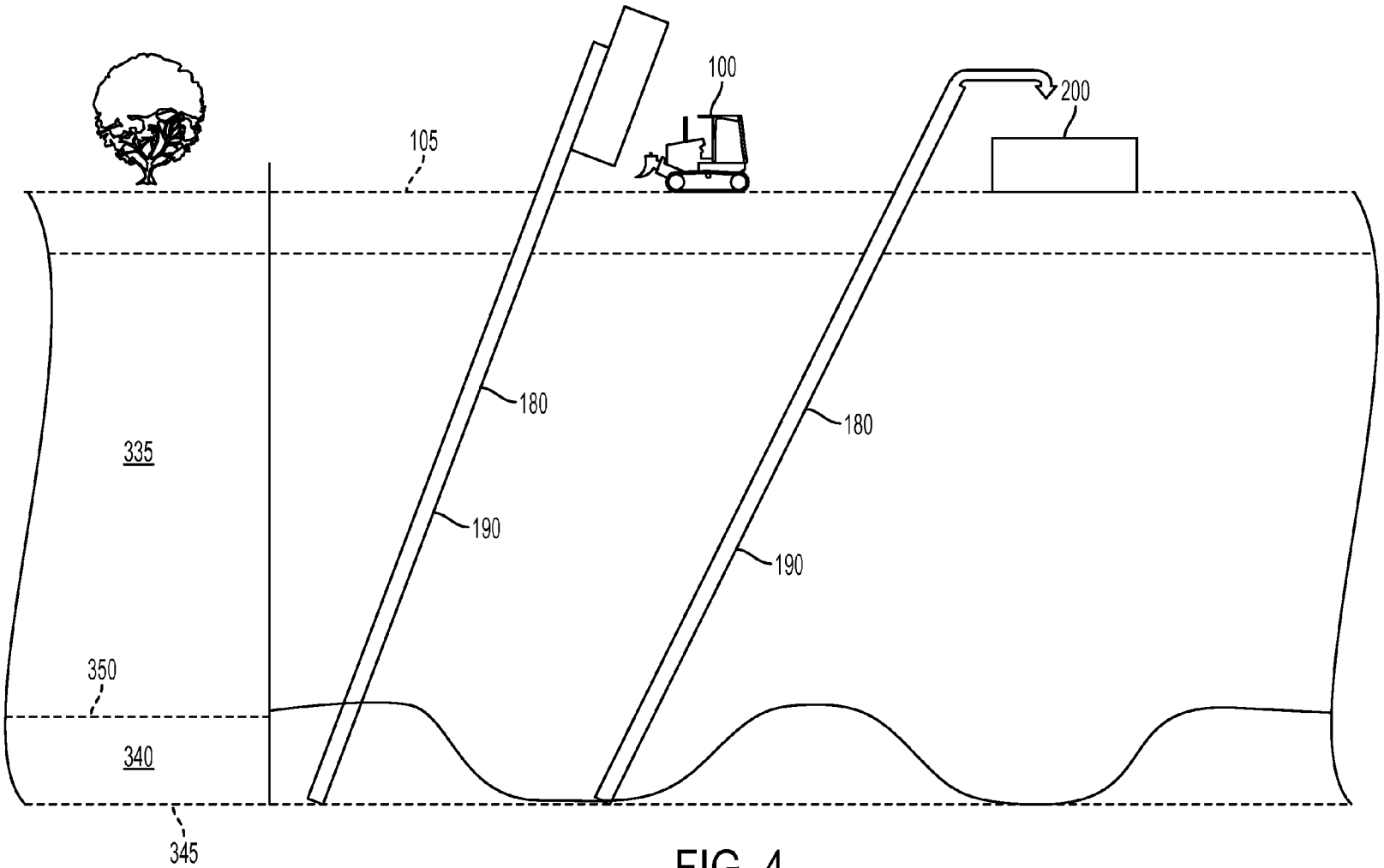
FIG. 4 is schematic diagram illustrating a system and method for sonic subsurface material removal, according to one aspect.

Referring now to FIGS. 3 and 4, in order to remove subsurface materials using sonic drilling techniques, a borehole 180 can be formed as in conventional sonic drilling. For example, a target drilling zone can be identified through obtaining sonic samples of geological formations 170. In one aspect, the outer casing 190 and/or the core barrel can be advanced through any overburden material 335 and the desired material 340 until a lower layer 345 of the desired material is reached. As can be appreciated, sonic technology allows for the installation of the outer casing to the lower layer of the desired geological formation without the use of drilling fluids or disturbance to the target geological formation around the borehole (i.e., the area around the borehole can remain substantially intact until the mining process commences). Further, sonic drilling technology can accurately identify the bottom of the desired geological formation so that the outer casing 190 can be properly positioned.

Upon locating the lower layer 345 of the desired material 340, a portion of the outer casing 190 can be retracted from the borehole 180. In one aspect, the outer casing can be retracted from the borehole a predetermined distance, such 1 foot, 2 feet, 3 feet and the like. In another aspect, the outer casing 190 can be retracted from the borehole until a distal end 320 of the outer casing is positioned a predetermined distance from the lower layer 345 and/or an upper layer 350 of the desired material. For example, the distal end of the outer casing can be positioned just below the upper layer of the desired material. In still another aspect, the distal end 320 of the outer casing can be positioned at any location between the upper and lower layers of the desired material. If the desired material 340 is a flowing material, such as, for example and without limitation, quartz or sand containing ore, upon retraction of the outer casing 190 the predetermined distance, the desired material can at least partially flow into the open borehole 180.

After the desired material has been located using the sonic drilling system 100, at least a portion of the sonic drilling system can be removed and replaced with the material removal system 200. Thus, at least a portion of the material removal system can be inserted into the same borehole 180 that was drilled to identify the location of the desired material 340. (FIG. 4 illustrates separate boreholes for clarity).

In one aspect, the outer tube 235 of the sonic air lift tooling system 210 can be coupled to an upper portion 355 of the outer casing 190. After placing the distal end 320 of the outer casing in the predetermined position relative to the lower layer 345 and/or the upper layer 350 of the desired material 340, the desired material can be removed from the borehole 180 using a plurality of removal methods, such as, for example and without limitation, a direct reverse lift method 420, and a flooded reverse lift method 430, illustrated in FIGS. 5-6 respectively.

As illustrated in FIG. 5, the direct reverse lift method 420 comprises injecting a pressurized fluid, such as air, water and the like through the outer tube inlet 265 of the outer tube 235. For example, a compressor 405 can urge pressurized air from above the surface 105 of the formation 170 through the annular void 277 defined between the outer tube/outer casing 190 and the inner tube 240 so that the pressurized fluid travels around the distal end 295 of the inner tube. Upon reaching the distal end of the inner tube, at least a portion of the pressurized fluid can pass through at least one hole 300 of the plurality of holes of the inner tube. As the distal end 320 of the outer casing 190 is typically below the water line 407 (i.e., at least portions of the borehole 180 and the interior conduit 285 of the inner tube 240 are filled with ground water), the pressurized fluid can bubble up through the ground water towards the surface. In one aspect, portions of the desired material 340, such as for example and without limitation, sand, can become entrained in the pressurized fluid as it bubbles up through the interior conduit 285 of the inner tube and can be carried towards the surface 105. Upon reaching the proximal end 280 of the inner tube, the portions of the desired material can be urged through the discharge head 260 to the discharge tank 230 for collection.

The flooded reverse lift method 430 comprises injecting a pressurized first fluid, such as air and the like through the outer tube inlet 265 of the outer tube 235. For example, a compressor 405 can urge pressurized air from above the surface 105 of the formation 170 through the annular void 277 defined between the outer tube/outer casing 190 and the inner tube 240. A second fluid, for example and without limitation, water, can also be injected into the outer casing so that the annular void defined between the inner tube and the outer casing is at least partially filled with a combination of the first and second fluids. In one aspect, water injected into the outer tube 235 can be water recycled from the discharge tank 230. The pressurized first fluid can travel down the annular void towards the distal end 295 of the inner tube. Upon reaching the distal end of the inner tube, at least a portion of the first pressurized fluid can pass through at least one hole 300 of the plurality of holes of the inner tube. As the distal end of the inner tube 240 is below the water line 407 (i.e., at least portions of the borehole 180 and the interior conduit 285 of the inner tube can be filled with ground water and/or the second fluid), the pressurized first fluid can bubble up through the water in the inner tube towards the surface 105. In one aspect, portions of the desired material 340, such as for example and without limitation, sand, can become entrained in the first fluid as it bubbles up through the interior conduit 285 of the inner tube and can be carried towards the surface. Upon reaching the proximal end 280 of the inner tube, the portions of the desired material can be urged through the discharge head 260 to the discharge tank 230 for collection.

Regardless of the lifting method used, if at any time the desired material 340 is no longer being brought to the surface 105 at a desired rate, in one aspect, the distal end 320 of the outer casing 190 can be adjusted to a different predetermined from the lower layer 345 and/or an upper layer 350 of the desired material. For example, if a low level of desired material is being extracted from the borehole 180, the outer casing can be lowered so that the distal end of the outer casing is adjusted to a different predetermined distance from the lower layer of the desired material 340.

The methods and systems described above require no particular component or function. Thus, any described component or function—despite its advantages—is optional. Also, some or all of the described components and functions described above may be used in connection with any number of other suitable components and functions.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A system for removing desired subsurface materials, the system comprising:

a sonic drilling subsystem for drilling into a formation comprising:

a drill head assembly; and at least one drill rod coupled thereto to form a drill string, wherein the drill string is coupled to a drill bit configured to interface with the formation to be drilled, wherein the drill head assembly is configured to rotate the drill string and transmit oscillating forces to the drill string forming a borehole below the surface of the formation, wherein the at least one drill rod forms an outer casing of the borehole, the outer casing having a lower portion and an upper portion, and wherein at least a portion of the drill head assembly is selectively detachable from the outer casing; and a sonic air lift tooling subsystem comprising:

an outer tube having an outer diameter and an inner volume, wherein a distal end of the outer tube is configured for selective coupling to the upper portion of the outer casing of the drilling subsystem following detachment of at least a portion of the drill head assembly from the outer casing, wherein an outer tube inlet is defined in a proximal end of the outer tube, and wherein the outer tube inlet is in fluid communication with a source of pressurized fluid; and an inner tube positioned in at least a portion of the inner volume of the outer tube, wherein, following coupling of the distal end of the outer tube to the upper portion of the outer casing, the outer tube and the outer casing cooperate to define an internal surface, wherein an annular void is defined between the outer tube, the internal surface and an outer diameter of the inner tube, wherein a distal end of the inner tube defines at least one opening such that an interior conduit of the inner tube is in fluid communication with the annular void, wherein the pressurized fluid passes from the annular void through the at least one opening to the interior conduit of the inner tube, wherein the desired subsurface material is entrained in the fluid in the interior conduit of the inner tube, and wherein a proximal end of the inner tube is in fluid communication with a discharge tank such that the fluid and the desired subsurface material are urged to the discharge tank.

2. The system for removing desired subsurface materials of claim 1, wherein the at least one opening comprises a plurality of holes extending from the outer diameter to the interior conduit of the inner tube.

3. The system for removing desired subsurface materials of claim 2, wherein at least one hole of the plurality of holes has a longitudinal axis positioned at an acute angle relative to a longitudinal axis of the inner tube.

4. The system for removing desired subsurface materials of claim 3, wherein each hole of the plurality of holes has a diameter of about 0.75 inches.

5. The system for removing desired subsurface materials of claim 1, wherein the distal end of the outer tube couples to the outer casing by threadingly engaging the upper portion of the outer casing.

6. The system for removing desired subsurface materials of claim 1, wherein the discharge tank comprises means for separating the desired subsurface material from the fluid in which it is entrained.

7. The system for removing desired subsurface materials of claim 6, wherein the means for separating comprises a recirculation baffle plate configured to allow a liquid to flow over the recirculation baffle plate while restricting the flow of solids.

8. The system for removing desired subsurface materials of claim 6, wherein the discharge tank further comprises a recirculation line configured to place the discharge tank in fluid communication with the outer tube inlet of the outer tube.

9. The system for removing desired subsurface materials of claim 1, wherein at least a portion of the drilling subsystem and at least a portion of the sonic air lift tooling subsystem are inserted into the same borehole.

10. The system for removing desired subsurface materials of claim 1, wherein an internal diameter of the outer tube is substantially the same as an internal diameter of the outer casing.

11. The system for removing desired subsurface materials of claim 1, wherein the pressurized fluid is air.

12. The system for removing desired subsurface materials of claim 11, further comprising a second fluid injected into the outer tube so that the annular void is at least partially filled with a combination of the pressurized fluid and the and second fluid.

13. The system for removing desired subsurface materials of claim 12, wherein the second fluid is water.

14. The system for removing desired subsurface materials of claim 13, wherein at least a portion of the water is recycled from the discharge tank.

15. The system for removing desired subsurface materials of claim 1, wherein the drilling subsystem further comprises a core barrel operatively coupled to the drill head assembly and configured to retrieve a core sample during formation of the borehole, wherein the core barrel is selectively detachable from remaining portions of the drilling subsystem.

16. A method for removing desired subsurface materials, the method comprising:

drilling into a surface of the earth with a sonic drill head assembly and at least one drill rod coupled thereto to form a drill string, wherein the drill string is coupled to a drill bit configured to interface with the material to be drilled, wherein the drill head assembly is configured to rotate the drill string and transmit oscillating forces to the drill string forming a borehole below the surface, and wherein the at least one drill rod forms an outer casing of the borehole, the outer casing having a lower portion and an upper portion;

detaching at least a portion of the sonic drill head assembly from the outer casing;

providing a sonic air lift tooling system comprising:

an outer tube having an outer diameter and an inner volume, wherein an outer tube inlet is defined in a proximal end of the outer tube, and wherein the outer tube inlet is in fluid communication with a source of pressurized fluid; and an inner tube positioned in at least a portion of the inner volume of the outer tube, wherein a distal end of the inner tube defines at least one opening to an interior conduit of the inner tube, and wherein a proximal end of the inner tube is in fluid communication with a discharge tank;

coupling a distal end of the outer tube to an upper portion of the outer casing, wherein, the outer tube and the outer casing cooperate to define an internal surface, and wherein an annular void is defined between the internal surface and an outer diameter of the inner tube;

injecting pressurized fluid from the source of pressurized fluid through the outer tube inlet into the annular void such that the pressurized fluid passes from the annular void through the at least one opening of the inner tube and to the interior conduit of the inner tube, wherein the desired subsurface material is entrained in the fluid passing into the interior conduit of the inner tube; and collecting the desired subsurface material from the discharge tank.

17. The method for removing desired subsurface materials of claim 16, wherein the at least one opening comprises a plurality of holes extending from the outer diameter to the interior conduit of the inner tube.

18. The method for removing desired subsurface materials of claim 17, wherein at least one hole of the plurality of holes has a longitudinal axis positioned at an acute angle relative to a longitudinal axis of the inner tube.

19. The method for removing desired subsurface materials of claim 16, wherein the pressurized fluid is air.

20. The method for removing desired subsurface materials of claim 16, wherein the discharge tank comprises means for separating the desired subsurface material from the fluid in which it is entrained.

21. The method for removing desired subsurface materials of claim 20, wherein the means for separating comprises a recirculation baffle plate configured to allow a liquid to flow over the recirculation baffle plate while restricting the flow of solids.

22. The method for removing desired subsurface materials of claim 16, wherein the step of drilling into a surface of the earth comprises obtaining a core sample using a core barrel operatively coupled to the drill head assembly, the method further comprising removing the core barrel from the borehole and detaching the core barrel from the drill head assembly.

* * * * *